US006841521B2

(12) United States Patent
Boffa et al.

(10) Patent No.: US 6,841,521 B2
(45) Date of Patent: Jan. 11, 2005

(54) METHODS AND COMPOSITIONS FOR REDUCING WEAR IN HEAVY-DUTY DIESEL ENGINES

(75) Inventors: Alexander B. Boffa, Richmond, CA (US); William M. Kleiser, Lafayette, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 10/383,426

(22) Filed: Mar. 7, 2003

(65) Prior Publication Data

US 2004/0176257 A1 Sep. 9, 2004

(51) Int. Cl.[7] ..... C10M 125/26; C10M 141/26

(52) U.S. Cl. ..... 508/156; 508/362; 508/390; 508/391

(58) Field of Search ..... 508/156–160

(56) References Cited

U.S. PATENT DOCUMENTS 3,853,772 A * 12/1974 Adams ..... 508/156
3,929,650 A * 12/1975 King et al. ..... 508/156
4,263,155 A * 4/1981 Frost ..... 508/156
4,472,288 A * 9/1984 Frost, Jr. ..... 508/159
4,534,873 A * 8/1985 Clark ..... 508/159
4,717,490 A * 1/1988 Salentine ..... 508/159
5,719,107 A 2/1998 Outten et al. ..... 598/185
6,103,672 A 8/2000 Dunn et al. ..... 508/185
6,331,510 B1 12/2001 Curtis et al. ..... 508/578
6,423,670 B2 * 7/2002 Locke et al. ..... 508/192
6,534,450 B1 * 3/2003 Harrison et al. ..... 508/158
6,632,781 B2 * 10/2003 Harrison et al. ..... 508/158
6,720,293 B2 * 4/2004 Bovington et al. ..... 508/192

* cited by examiner

*Primary Examiner*—Ellen M. McAvoy
(74) *Attorney, Agent, or Firm*—Claude J. Caroli; Joseph P. Foley; Joseph I. Jones

(57) ABSTRACT

Disclosed are methods and lubricant compositions for reducing wear in heavy-duty diesel engines. The lubricant compositions disclosed herein comprise a combination of an anti-wear effective amount of a dispersed, hydrated alkali metal borate, a neutral sulfonate and an overbased detergent composition.

10 Claims, No Drawings

METHODS AND COMPOSITIONS FOR REDUCING WEAR IN HEAVY-DUTY DIESEL ENGINES

FIELD OF THE INVENTION

This invention is directed, in part, to methods and lubricant compositions for reducing wear in heavy-duty diesel engines. In a preferred aspect, the lubricant compositions of this invention comprise a combination of an anti-wear effective amount of a dispersed, hydrated alkali metal borate, a neutral sulfonate, and an overbased detergent composition.

REFERENCES

The following references are cited in this application as superscript numbers:

[1] Dunn, et al., Lubricating Oil Compositions, U.S. Pat. No. 6,103,672, issued Aug. 15, 2000

[2] Outten, Crankcase Lubricant for Heavy Duty Diesel Oil, U.S. Pat. No. 5,719,107, issued Feb. 17, 1998

[3] Curtis, et al., Synthetic Diesel Engine Lubricants Containing Dispersant-Viscosity Modifier and Functionalized Phenol Detergent, U.S. Pat. No. 6,331,510, issued Dec. 18, 2001

All of the above references are herein incorporated by reference in their entirety to the same extent as if each individual reference was specifically and individually indicated to be incorporated by reference in its entirety.

State of the Art

Over the years, the heavy-duty trucking market has adopted the diesel engine as its preferred power source due to both its excellent longevity and its economy of operation. Specialized lubricants have been developed to meet the more stringent performance requirements of heavy-duty diesel engines compared to passenger car engines.

Recently, the specifications for heavy-diesel engines indicate a longer interval between oil changes than has been customary in the past. In order to formulate engine oils with longer drain intervals, higher levels of certain additives such as detergents and, in particular, overbased detergents have been incorporated into the lubricant composition.[3] Higher concentrations of detergents have been necessary in order to control deposits during such extended intervals.

Typically, such higher concentrations of overbased detergents in the lubricant compositions have increased the total base number of the finished oil to at least about 5.

As noted in the art, while higher concentrations of detergents provide acceptable deposit control during extended drain intervals, their use results in increased engine wear in heavy-duty diesel engines, particularly valve train wear, as measured in a Cummings M11 valve train wear test.[3]

Curtis, et al.[3] disclose heavy-duty lubricant compositions suitable for use during extended drain periods. The compositions disclosed therein employ a synthetic base stock in combination with a sulfur-free functionalized hydrocarbyl-substituted phenol detergent. According to Curtis, et al., this combination provides both acceptable extended drain intervals with a concomitant acceptable wear results in such heavy-duty diesel engines.

Synthetic lubricants, however, significantly increase the costs of the lubricant composition. In some cases, the increased cost of synthetic lubricants is justified, whereas, in other cases, it is not. Accordingly, it would be particularly beneficial to find a combination of additives which, when combined into a lubricant composition suitable for use in heavy-duty diesel engines, would provide both extended drain intervals and acceptable wear in natural and synthetic lubricating oil formulations.

This invention is directed to the discovery that wear in heavy-duty diesel engines arising from the use of lubricating oil compositions comprising high concentrations of overbased detergent can be reduced by incorporating an alkali metal borate into these compositions.

With regard to the above, the art has disclosed combinations of detergents with borate dispersants for use in marine cylinder lubricant compositions.[1]

SUMMARY OF THE INVENTION

As noted above, this invention is directed, in part, to lubricant compositions particularly suitable for extended use in heavy-duty diesel engines. Such lubricant compositions comprise a combination of a neutral sulfonate, an overbased detergent composition and a dispersed, hydrated alkali metal borate. This combination of additives in the lubricant composition reduces wear levels during operation of heavy-duty diesel engines while maintaining acceptable deposit control over prolonged use.

Accordingly, in one of its composition aspects, this invention is directed to a lubricating oil composition suitable for use in a heavy-duty diesel engine which composition comprises a major amount of an oil of lubricating viscosity,

- a sufficient amount of an overbased detergent additive to control deposits during operation of said heavy-duty diesel engine;
- a sufficient amount of a neutral alkali or alkaline earth metal sulfonate having a TBN of less than 25 to control deposits during high temperature operation of said heavy-duty diesel engine; and
- a sufficient amount of a dispersed, hydrated alkali metal borate to inhibit wear during operation of said heavy-duty diesel engine.

In a preferred embodiment, sufficient amounts of the overbased detergent additive are employed to provide a total base number (TBN) to the finished lubricant composition of at least about 5. More preferably, the finished lubricant composition has a TBN of from about 5 to 20. In one embodiment the finished lubricant composition has a TBN of from 12 to 15. In another embodiment, the finished lubricant composition has a TBN of from 5 to less than 10.

In another preferred embodiment, the dispersed hydrated alkali metal borate composition is present in an amount of from about 0.1 to about 5 weight percent of the total weight of the lubricant composition and, even more preferably, from about 0.2 to 2 weight percent.

Preferably, the dispersed hydrated alkali metal borate is a dispersed hydrated potassium borate.

In another preferred embodiment, the composition further comprises a molybdenum/nitrogen-containing complex that is employed in an amount sufficient to impart anti-wear and anti-oxidant properties to the composition.

In one of its method aspects, this invention is directed to a method for controlling wear and deposits during operation of a heavy-duty diesel engine, which method comprises:

- operating the engine with a lubricant composition comprising a major amount of an oil of lubricating viscosity,
- a sufficient amount of an overbased detergent additive to control deposits during operation of said heavy-duty diesel engine;

a sufficient amount of a neutral alkali or alkaline earth metal sulfonate having a TBN of less than 25 to control deposits during high temperature operation of said heavy-duty diesel engine; and a sufficient amount of a dispersed, hydrated alkali metal borate to inhibit wear during operation of said heavy-duty diesel engine.

DETAILED DESCRIPTION OF THE INVENTION

This invention is directed, in part, to novel lubricant compositions comprising a combination of an overbased detergent additive, a neutral sulfonate, and a dispersed, hydrated alkali metal borate. This combination unexpectedly provides both wear and deposit protection during operation of heavy-duty diesel engines.

Each of these components in the claimed composition will be described in detail herein. However, prior to such a description, the following term will first be defined.

The term "hydrocarbyl" as used herein refers to an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. More preferably, hydrocarbyl groups comprise from 1 to 300 carbon atoms and even more preferably 6–100 carbon atoms.

Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., hydroxyalkyls, such as 2-hydroxyethyl, 3-hydroxypropyl, hydroxyisopropyl, 4-hydroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, 2-(2-ethoxyethoxy)ethyl, 2-(2-(2-ethoxyethoxy)ethoxy)ethyl, 3,6,9,12-tetraoxatetradecyl, 2-(2-ethoxyethoxy)hexyl, etc.

The Hydrated Alkali Metal Borate

Hydrated alkali metal borates are well known in the art. Representative patents disclosing suitable borates and methods of manufacture include: U.S. Pat. Nos. 3,313,727; 3,819,521; 3,853,772; 3,912,643; 3,997,454; and 4,089,790 all of which are incorporated herein by reference in their entirety.

The hydrated alkali metal borates suitable for use in the present invention can be represented by the following general formula:

$$M_2O \cdot xB_2O_3 \cdot yH_2O$$

wherein M is an alkali metal, preferably sodium or potassium; x is a number from 2.5 to 4.5 (both whole and fractional); and y is a number from 1.0 to 4.8. More preferred are the hydrated potassium borates, particularly the hydrated potassium triborates. The hydrated borate particles will generally have a mean particle size of less than 1 micron.

In the alkali metal borates employed in this invention, the ratio of boron to alkali metal will preferably range from about 2.5:1 to about 4.5:1.

Oil dispersions of hydrated alkali metal borates are generally prepared by forming, in deionized water, a solution of alkali metal hydroxide and boric acid, optionally in the presence of a small amount of the corresponding alkali metal carbonate. The solution is then added to a lubricant composition comprising an oil of lubricating viscosity, a dispersant and any optional additives to be included therein (e.g., a detergent, or other optional additives) to form an emulsion that is then dehydrated.

Because of their retention of hydroxyl groups on the borate complex, these complexes are referred to as "hydrated alkali metal borates" and compositions containing oil/water emulsions of these hydrated alkali metal borates are referred to as "oil dispersions of hydrated alkali metal borates".

Preferred oil dispersions of alkali metal borates will have a boron to alkali metal ratio of about 2.5:1 to about 4.5:1. In another preferred embodiment, the hydrated alkali metal borate particles generally will have a mean particle size of less than 1 micron. In this regard, it has been found that the hydrated alkali metal borates employed in this invention preferably will have a particle size where 90% or greater of the particles are less than 0.6 microns.

In the oil dispersion of hydrated alkali metal borate, the hydrated alkali metal borate will generally comprise about 10 to 75 weight percent, preferably 25 to 50 weight percent, more preferably about 30 to 40 weight percent of the total weight of the oil dispersion of the hydrated borate. (Unless otherwise stated, all percentages are in weight percent.) This composition or concentrate is employed, often in the form of an additive package, to form the finished lubricant composition. Sufficient amounts of the concentrate are added so that the finished lubricant composition preferably comprises from about 0.1 to about 5 weight percent of borate actives and, even more preferably, from about 0.2 to 2 weight percent.

The lubricant compositions of this invention can further employ surfactants, detergents, other dispersants and other conditions as described below and known to those skilled in the art.

The oil dispersions of hydrated alkali metal borates employed in this invention generally comprise a dispersant, an oil of lubricating viscosity, and optionally a detergent, that are further detailed below.

The Overbased Detergent Additive

Overbased detergent additives are well known in the art and preferably are alkali or alkaline earth metal overbased detergent additives. Such detergent additives are prepared by reacting a metal oxide or metal hydroxide with a substrate and carbon dioxide gas. The substrate is typically an acid, usually an acid selected from the group consisting of aliphatic substituted sulfonic acids, aliphatic substituted carboxylic acids, and aliphatic substituted phenols.

The terminology "overbased" relates to metal salts, preferably, metal salts of sulfonates, carboxylates and phenates, wherein the amount of metal present exceeds the stoichiometric amount. Such salts are said to have conversion levels in excess of 100% (i.e., they comprise more than 100% of the theoretical amount of metal needed to convert the acid to its "normal", "neutral" salt). The expression "metal ratio", often abbreviated as MR, is used in the prior art and herein to designate the ratio of total chemical equivalents of metal in the overbased salt to chemical equivalents of the metal in a neutral salt according to known chemical reactivity and stoichiometry. Thus, in a normal or neutral salt, the metal ratio is one and in an overbased salt, MR, is greater than one. They are commonly referred to as overbased, hyperbased or superbased salts and are usually salts of organic sulfur acids, carboxylic acids, or phenols.

The alkali metal overbased detergent typically has a metal ratio of at least 10:1, preferably at least 13:1 and most preferably at least 16:1. The alkaline overbased detergent typically has a metal ratio of at least 10:1, preferably at least 12:1 and more preferably at least 20:1.

Sulfonic acids include the mono or polynuclear aromatic or cycloaliphatic compounds which, when overbased, are called sulfonates. The oil soluble sulfonates can be represented for the most part by the following formulae:

$$[(R^3)_x\text{-T-}(SO_3)_y]_zM_f \quad \text{I}$$

$$[R^4(SO_3)_g]_hM_i \quad \text{II}$$

In the above formulae, M is a metal cation as described hereinabove; T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydronaphthalene, cyclopentane, etc.; $R^3$ in Formula I is an aliphatic group such as alkyl, alkenyl, alkoxy, alkoxyalkyl, carboalkoxyalkyl, etc.; x is at least 1, and $(R^3)_x$+T contains a total of at least 15 carbon atoms, $R^4$ in Formula II is an aliphatic group as described herein containing at least about 9, preferably at least about 12 and often at least about 15 carbon atoms and M is a metal cation. Examples of type of the $R^4$ radical are alkyl, alkenyl, alkoxyalkyl, carboalkoxyalkyl, etc. Specific examples of $R^4$ are groups derived from petrolatum, saturated and unsaturated paraffin wax, and polyolefins, including polymerized $C_2$, $C_3$, $C_4$, $C_5$, $C_6$, etc., olefins containing up to about 7000 carbon atoms in the polymer. The groups T, $R^3$, and $R^4$ in the above formulae can also contain other inorganic or organic substituents in addition to those enumerated above such as, for example, hydroxy, mercapto, halogen, nitro, amino, nitroso, sulfide, disulfide, etc. In the above Formulae I and II, each of x, y, z, f, g, i, and h is at least 1.

Specific examples of sulfonic acids useful in this invention are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono and polywax substituted sulfonic and polysulfonic acids of, e.g., benzene, naphthalene, phenol, diphenyl ether, naphthalene disulfide, diphenylamine, thiophene, alphachloronaphthalene, etc.; other substituted sulfonic acids such as alkyl benzene sulfonic acids (where the alkyl group has at least 8 carbons), cetylphenol monosulfide sulfonic acids, dicetyl thianthrene disulfonic acids, dilauryl beta naphthyl sulfonic acid, dicapryl nitronaphthalene sulfonic acids, and alkaryl sulfonic acids such as dodecyl benzene "bottoms" sulfonic acids.

The bottoms acids are derived from benzene that has been alkylated with propylene tetramers or isobutene trimers to introduce 1, 2, 3 or more branched chain $C_{12}$ substituents on the benzene ring. Dodecyl benzene bottoms, principally mixtures of mono and didodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture products by reaction with, e.g., $SO_3$, is well known to those skilled in the art. See, for example, the articles "Sulfonation and Sulfation", Vol. 23, pp. 146 et seq. and "Sulfonic Acids", Vol. 23, pp. 194 et seq, both in Kirk Othmer "Encyclopedia of Chemical Technology", Fourth Edition, published by John Wiley & Sons, N.Y. (1997).

Also included are aliphatic sulfonic acids containing at least about 7 carbon atoms, often at least about 12 carbon atoms in the aliphatic group, such as paraffin wax sulfonic acids, unsaturated paraffin wax sulfonic acids, hydroxy substituted paraffin wax sulfonic acids, hexapropylene sulfonic acids, tetraamylene sulfonic acids, polyisobutene sulfonic acids wherein the polyisobutene contains from 20 to 7000 or more carbon atoms, chloro substituted paraffin wax sulfonic acids, nitroparaffiin wax sulfonic acids, etc.; cycloaliphatic sulfonic acids such as petroleum naphthene sulfonic acids, cetyl cyclopentyl sulfonic acids, lauryl cyclohexyl sulfonic acids, bis (isobutyl)cyclohexyl sulfonic acids, etc.

With respect to the sulfonic acids or salts thereof described herein, it is intended that the term "petroleum sulfonic acids" or "petroleum sulfonates" includes all sulfonic acids or the salts thereof derived from petroleum products. A particularly valuable group of petroleum sulfonic acids are the mahogany sulfonic acids (so called because of their reddish brown color) obtained as a by-product from the manufacture of petroleum white oils by a sulfonic acid process.

Other descriptions of overbased sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,297; 2,315,514; 2,319,121; 2,321,022; 2,333,568; 2,333,788; 2,335,259; 2,337,552; 2,346,568; 2,366,027; 2,374,193; 2,383,319; 3,312,618; 3,471,403; 3,488,284; 3,595,790; and 3,798,012. Each of these patents is hereby incorporated by reference in its entirety.

Carboxylic acids from which suitable alkali and alkaline overbased detergents for use in this invention can be made include aliphatic mono- and poly-basic carboxylic acids. The aliphatic carboxylic acids generally contain at least 9 carbon atoms, often at least 15 carbon atoms and preferably at least 18 carbon atoms. Usually, they have no more than 400 carbon atoms. Generally, if the aliphatic carbon chain is branched, the acids are more oil soluble for any given carbon atoms content. The aliphatic carboxylic acids can be saturated or unsaturated. Specific examples include linolenic acid, linoleic acid, behenic acid, isostearic acid, stearic acid, palmitoleic acid, lauric acid, oleic acid, ricinoleic acid, commercially available mixtures of two or more carboxylic acids, such as tall oil acids, rosin acids, and the like.

Preferred aliphatic carboxylic acids are of the formula

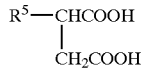

wherein $R^5$ is an aliphatic hydrocarbon based group of at least 7 carbon atoms, often at least 12 carbon atoms and preferably, at least 15 carbon atoms, and not more than about 400 carbon atoms, and reactive equivalents thereof.

In another embodiment, the carboxylic acid is a hydrocarbyl substituted carboxyalkylene linked phenol; dihydrocarbyl ester of alkylene dicarboxylic acids, the alkylene group being substituted with a hydroxy group and an additional carboxylic acid group; alkylene linked polyaromatic molecules, the aromatic moieties whereof comprise at least one hydrocarbyl substituted phenol and at least one carboxy phenol; and hydrocarbyl substituted carboxyalkylene linked phenols.

These carboxylic compounds are prepared by reacting a phenolic reagent with a carboxylic reagent of the general formula $R^{11}C(O)(CR^{12}R^{13})_xCOOR^{16}$ wherein $R^{11}$, $R^{12}$ and $R^{13}$ are independently hydrogen or a hydrocarbyl group, $R^{16}$ is H or an alkyl group, and x is an integer ranging from 0 to about and reactive equivalents thereof. Compounds of this type are described in several U.S. patents including U.S. Pat. Nos. 5,281,346; 5,336,278 and 5,356,546 each of which is incorporated by reference in its entirety.

Unsaturated hydroxycarboxylic compounds prepared by reacting olefinic compounds with this carboxylic compound are also useful. Compounds of this type are described in several U.S. patents including U.S. Pat. Nos. 5,696,060; 5,696,067; 5,777,142 and 6,020,500 each of which is incorporated by reference in its entirety.

Aromatic carboxylic acids are useful for preparing metal salts useful in the compositions of this invention. These include aromatic carboxylic acids such as hydrocarbyl substituted benzoic, phthalic and salicylic acids.

Salicylic acids and other aromatic carboxylic acids are well known or can be prepared according to procedures known in the art. Carboxylic acids of this type and processes for preparing their neutral and basic metal salts are well known and disclosed, for example, in U.S. Pat. Nos. 2,197,832; 2,197,835; 2,252,662; 2,252,664 2,714,092; 3,410,798; and 3,595,791. Each of these patents is incorporated herein by reference in its entirety.

In the context of this invention, phenols are considered organic acids. Thus, overbased salts of phenols (generally known as phenates) are also useful in making the overbased detergents of this invention and are well known to those skilled in the art.

A commonly available class of phenates are those made from phenols of the general formula:

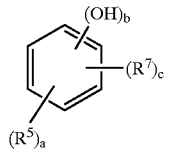

wherein $R^5$ is as described hereinabove, $R^7$ is a lower aliphatic of from 1 to 6 carbon atoms, a is an integer of from 1 to 3, b is 1 or 2 and c is 0 or 1.

One particular class of phenates for use in this invention are the overbased phenates made by sulfurizing a phenol as described hereinabove with a sulfurizing agent such as sulfur, a sulfur halide or sulfide or hydrosufide salt. Techniques for making sulfurized phenates are described in U.S. Pat. Nos. 2,680,096; 3,036,971; and 3,775,321 which are expressly incorporated herein by reference in their entirety.

Other phenates that are useful are those that are made from phenols that have been linked through alkylene (e.g., methylene) bridges. These phenates are made by reacting single or multi-ring phenols with aldehydes or ketones, typically in the presence of an acid or basic catalyst. Such linked phenates, as well as sulfurized phenates, are described in detail in U.S. Pat. No. 3,350,038, particularly columns 6–8, thereof which patent is expressly incorporated herein by reference in its entirety.

Salicylic acids may be considered to be carboxylic acids or phenols. Hydrocarbyl substituted salicylic acids are useful for preparing metal salts useful in the compositions of this invention.

Preferred overbased metal salts are the substituted sulfonic acid salts and/or hydrocarbyl substituted phenates (including combinations thereof.

Preferably, sufficient amounts of the overbased detergents are present to provide for a TBN of at least 5 in the finished lubricant oil composition and, more preferably a TBN of from about 5 to about 20. The concentration of overbased detergent is, of course, dependent on the TBN of the overbased detergent composition employed which is well within the skill of the art. Preferably, however, the finished lubricant composition comprises from about 0.2 to 20 weight percent of actives in the overbased detergent composition based on the total weight of the finished oil.

Overbased detergents are well known in the art and are commercially available. In addition, numerous examples are provided in International Application Publication No. WO 01/44419 which is incorporated herein by reference in its entirety.

The Neutral Sulfonate Additive

The alkali or alkaline earth metal neutral sulfonate is described above with the exception that the MR employed in the neutralization reaction of the corresponding sulfonic acid is controlled to provide for a composition having a TBN of less than about 25 and that no carbon dioxide is utilized during this neutralization. Preferably, the neutral alkali or alkaline earth metal sulfonate has a TBN of less than 15. Even more preferably, the MR employed during the neutralization reaction is from 1 to about 3 and even more preferably the MR is about 1.

The neutral alkali or alkaline earth metal sulfonate is employed to assist in the control of deposits during high temperature operation of said heavy-duty diesel engine (e.g., temperatures of from about 100° C. to about 400° C.).

The neutral alkali or alkaline earth metal sulfonate is preferably employed in amounts ranging from about 0.2 to about 5.0 weight percent based on the total weight of the finished lubricant composition.

The Oil of Lubricating Viscosity

The oil of lubricating viscosity used in the compositions and methods of this invention may be mineral oils or synthetic oils of viscosity suitable for use in the crankcase of an internal combustion engine. The base oils may be derived from synthetic or natural sources. Mineral oils for use as the base oil in this invention include paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

Formulations

The compositions of this invention preferably comprise the following:

an oil of lubricating viscosity;

a sufficient amount of a dispersed, hydrated alkali metal borate to control deposits during operating of a heavy-duty diesel engine;

a sufficient amount of a neutral alkali or alkaline earth metal sulfonate having a TBN of less than 25 to control deposits during high temperature operation of said heavy-duty diesel engine;

a sufficient amount of an overbased detergent additive to inhibit wear during operation of a heavy-duty diesel engine; and optional additives.

The dispersed hydrated alkali metal borate is preferably present in the composition in an amount of from about 0.1 to about 5 weight percent of the total weight of the lubricant composition and, even more preferably, from about 0.2 to 2 weight percent.

The overbased detergent is preferably present in the composition in an amount sufficient to provide for a TBN of at least 5 in the finished lubricant oil composition and, more preferably a TBN of from about 5 to about 10. The concentration of overbased detergent is, of course, dependent on the TBN of the overbased detergent composition employed which is well within the skill of the art. Preferably, however, the finished lubricant composition comprises from about 0.2 to 20 weight percent of actives in the overbased detergent composition based on the total weight of the finished oil.

Preferably, the amount of oil of lubricating viscosity ranges up to about 99 weight percent of the composition based on the total weight of the composition.

These compositions are prepared merely by mixing the appropriate amounts of each of these components until a homogenous composition is obtained.

The following additive components are examples of some of the components that can be optionally employed in the compositions of this invention. These examples of additives are provided to illustrate the present invention, but they are not intended to limit it:

(1) Oxidation inhibitors (a) Phenol type oxidation inhibitors: 4,4'-methylene bis (2,6-di-tert-butylphenol), 4,4'-bis(2,6-di-tert-butylphenol), 4,4'-bis(2-methyl-6-tert-butylphenol), 2,2'-methylene bis(4-methyl-6-tert-butylphenol), 4,4'-butylene bis(3-methyl-6-tert-butylphenol), 4,4'-isopropylene bis(2,6-di-tert-butylphenol), 2,2'-methylene bis(4-methyl-6-nonylphenol), 2,2'-isobutylene bis(4,6-dimethylphenol), 2,2'-methylene bis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-.alpha.-dimethylamino-p-cresol, 2,6-di-tert-4-(N.N'-dimethylaminomethylphenol), 4,4'-thiobis(2-methyl-6-tert-butylphenol), 2,2'-thiobis(4-methyl-6-tert-butylphenol), and bis(3-methyl-4-hydroxy-5-tert-butylbenzyl)-sulfide.

(b) Diphenyl amine type oxidation inhibitor: alkylated diphenyl amine, phenyl-.alpha.-naphthylamine, and alkylated .alpha.-naphthylamine.

(c) Other types: metal dithiocarbamate (e.g., zinc dithiocarbamate), and methylenebis (dibutyidithiocarbamate).

(2) Rust inhibitors (Anti-rust agents)

(a) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

(b) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(3) Demulsifiers:

addition product of alkylphenol and ethylene oxide, poloxyethylene alkyl ether, and polyoxyethylene sorbitan ester.

(4) Extreme pressure agents (EP agents):

sulfurized oils, diphenyl sulfide, methyl trichlorostearate, chlorinated naphthalene, fluoroalkylpolysiloxane, and lead naphthenate.

(5) Friction modifiers:

fatty alcohol, fatty acid, amine, borated ester (such as borated glycerol monooleate), and other esters.

(6) Multifunctional additives:

sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenym complex compound.

(7) Viscosity index improvers:

polymethacrylate type polymers, ethylene-propylene copolymers, styrene-isoprene copolymers, hydrated styrene-isoprene copolymers, polyisobutylene, and dispersant type viscosity index improvers.

(8) Pour point depressants:

polymethyl methacrylate.

(9) Foam Inhibitors:

alkyl methacrylate polymers and dimethyl silicone polymers.

(10) A molybdenum containing additive such as molybdenum/nitrogen-containing complexes.

Complexes of molybdic acid and an oil soluble basic nitrogen-containing compound have been used as lubricating oil additives to control oxidation and wear of engine components. Since their discovery, such complexes have been widely used as engine lubricating oil additives in automotive crankcase oils.

Such complexes are described in detail in pending U.S. patent application Ser. No. 10/212,027, filed Aug. 1, 2002, which application is incorporated herein by reference in its entirety.

EXAMPLES

The invention will be further illustrated by the following examples, which set forth particularly advantageous method embodiments. While the examples are provided to illustrate the present invention, they are not intended to limit it.

As used in these examples and elsewhere in the specification, the following abbreviations have the following meanings. If not defined, the abbreviation will have its art recognized meaning.

cSt=centistokes

L=liter

MW=molecular weight ppm=parts per million rpm=rotations per minute

VI=viscosity index

In addition, all percents recited below are weight percents based on the total weight of the composition described unless indicated otherwise.

Comparative Examples A and B

The purpose of these comparative examples is to measure the effect on wear during operation of a heavy duty diesel engine arising from the use of a lubricant composition comprising sufficient amounts of overbased detergent to provide for a TBN in the finished composition of greater than 5 and a neutral sulfonate.

Specifically, a first fully formulated lubricating oil composition (Comparative Example A) was prepared using the following additives:

| | |
|---|---|
| Succinimide dispersant (2300 MW) | 7.0 weight percent |
| Neutral calcium sulfonate (TBN 17) | 7 millimoles |
| High overbased magnesium sulfonate | 13 millimoles |
| High overbased calcium phenate | 63 millimoles |
| Zinc dithiophosphate | 19 millimoles |
| molybdenum succinimide antioxidant | 0.2 weight percent |
| VI improver | 9.4 weight percent |
| antifoam | 2 ppm |

A second fully formulated lubricating oil composition (Comparative Example B) was prepared using the following additives:

| | |
|---|---|
| Succinimide dispersant (2300 MW) | 7.0 weight percent |
| Neutral calcium sulfonate (TBN 17) | 7 millimoles |
| High overbased magnesium sulfonate | 13 millimoles |
| High overbased calcium phenate | 63 millimoles |
| Zinc dithiophosphate | 19 millimoles |
| molybdenum succinimide antioxidant | 0.2 weight percent |
| VI improver | 9 weight percent |
| antifoam | 10 parts per million |
| sulfurized ester (antioxidant/antiwear) | 1 weight percent |

In each case, the balance of the composition comprised a mixture of base stocks comprising a Group I base oil having a kinematic viscosity of 6.6 cSt at 100° C. to provide for a 15W40 oil.

These compositions were individually tested for wear performance in a M11HST-standard test method for Cummins M11 high soot test valve bridge wear in the Cummins M11 heavy duty diesel engine. This test provides a stringent measure of heavy duty diesel motor oil (HDMO) performance. The PC-7 HDMO specification includes the Cummins M11 as the primary test of soot related valve train wear. The M11 has 4–50 hour phases of operation.

Phases 1 and 3 run under conditions to enhance soot formation, 1800 rpm, over-fueled, and retarded timing. Phases 2 and 4 run at 1600 rpm and standard timing. Operation under conditions of over-fueling and retarded timing leads to significant soot build up in the oil. At 200 hrs, the engine is disassembled and the valve bridge parts are weighed. Valve bridge, cross head wear is reported in mg weight loss. The engine employed in this test is a 6 cylinder, 11.0 L displacement.

The results of this evaluation at 200 hours of testing are set forth in the table below:

| Example | Amount of Wear |
|---|---|
| Comparative Example A | 13.14 mg |
| Comparative Example B | 13.23 mg |

(mg of weight refer to the average weight loss of the 12 valve bridges in the engine)

These results evidence that the addition of a conventional anti-wear agent (Comparative Example B—sulfurized ester) had no impact on the wear properties of a fully formulated heavy duty diesel engine lubricant composition.

Example 1

The purpose of this example is to demonstrate that improved wear performance is achieved by adding a dispersed, hydrated alkali metal borate to the lubricant composition.

Specifically, a fully formulated lubricating oil compositions was prepared using the following additives:

| | |
|---|---|
| Succinimide dispersant (2300 MW) | 7.0 weight percent |
| Neutral calcium sulfonate (TBN 17) | 7 millimoles |
| High overbased magnesium sulfonate | 13 millimoles |
| High overbased calcium phenate | 63 millimoles |
| Zinc dithiophosphate | 19 millimoles |
| molybdenum succinimide antioxidant | 0.2 weight percent |
| VI improver | 9 weight percent |
| antifoam | 10 ppm |
| potassium borate (OLOA 9750) | 2 weight percent |

(OLOA 9750 is commercially available from Chevron Oronite Company LLC, Houston, Texas, USA)

The balance of the composition comprised a mixture of base stocks comprising a Group I base oil having a kinematic viscosity of 6.6 cSt at 100° C. to provide for a 15W40 oil.

This composition was tested for wear performance in a M11HST-standard test method for Cummins M11 high soot test valve bridge wear in the Cummins M11 heavy duty diesel engine as described above.

The results of this evaluation at 200 hours of testing are set forth in the table below:

| Example | Amount of Wear |
|---|---|
| Example 1 | 6.31 mg |

(mg of weight refer to the average weight loss of the 12 valve bridges in the engine)

This result, when compared to the results of Comparative Examples A and B evidence that the addition of the dispersed, hydrated alkali metal borate to the fully formulated lubricant composition provided a significant reduction in wear.

From the foregoing description, various modifications and changes in the above described invention will occur to those skilled in the art. All such modifications coming within the scope of the appended claims are intended to be included therein.

What is claimed is:

1. A heavy-duty diesel engine lubricating oil composition comprising a major amount of an oil of lubricating viscosity, a) a sufficient amount of an overbased detergent additive to control deposits during operation of a heavy-duty diesel engine;

b) a sufficient amount of a neutral alkali or alkaline earth metal sulfonate having a TBN of less than 25 to control deposits during high temperature operation of said heavy-duty diesel engine; and c) a sufficient amount of a dispersed, hydrated alkali metal borate to inhibit wear during operation of said heavy-duty diesel engine.

2. The lubricating oil composition according to claim 1, wherein sufficient amounts of the overbased detergent additive are employed to provide a TBN to the finished lubricant composition of at least about 5.

3. The lubricating oil composition according to claim 2, wherein the finished lubricant composition has a TBN of from about 5 to 20.

4. The lubricating oil composition according to claim 3, wherein the finished lubricant composition has a TBN of from 12 to 15.

5. The lubricating oil composition according to claim 1, wherein the dispersed hydrated alkali metal borate composition is present in an amount of from about 0.1 to about 5 weight percent of the total weight of the lubricant composition.

6. The lubricating oil composition according to claim 5, wherein the dispersed hydrated alkali metal borate composition is present in an amount of from about 0.2 to 2 weight percent.

7. The lubricating oil composition according to claim 1, wherein the dispersed hydrated alkali metal borate is a dispersed hydrated potassium borate.

8. The lubricating oil composition according to claim 1, wherein the neutral alkali or alkaline earth metal sulfonate is present in an amount of from about 0.2 to 5 weight percent based on the total weight of the composition.

9. The lubricating oil composition according to claim 1, which further comprises an anti-wear and anti-oxidant effective amount of a molybdenum/nitrogen-containing complex.

10. A method for controlling wear and deposits during operation of a heavy-duty diesel engine, comprising operating the heavy duty diesel engine with a lubricating oil composition, wherein said lubricating oil composition comprises:

a) a major amount of an oil of lubricating viscosity, b) a sufficient amount of an overbased detergent additive to control deposits during operation of said heavy-duty diesel engine;

c) a sufficient amount of a neutral alkali or alkaline earth metal sulfonate having a TBN of less than 25 to control deposits during high temperature operation of said heavy-duty diesel engine; and d) a sufficient amount of a dispersed, hydrated alkali metal borate to inhibit wear during operation of said heavy-duty diesel engine.

* * * * *